US010959900B2

(12) United States Patent
Girelli et al.

(10) Patent No.: US 10,959,900 B2
(45) Date of Patent: Mar. 30, 2021

(54) DENTAL PATIENT CHAIR

(71) Applicant: CEFLA SOCIETÁ COOPERATIVA, Imola (IT)

(72) Inventors: Francesco Girelli, Imola (IT); Stefano Grandi, Imola (IT)

( * ) Notice: Subject to any disclaimer, the term of this patent is extended or adjusted under 35 U.S.C. 154(b) by 0 days.

(21) Appl. No.: 16/653,719

(22) Filed: Oct. 15, 2019

(65) Prior Publication Data

US 2020/0121537 A1 Apr. 23, 2020

(30) Foreign Application Priority Data

Oct. 23, 2018 (IT) ..... 102018000009691

(51) Int. Cl.
*A61G 15/02* (2006.01)
*A47C 1/032* (2006.01)
*A61G 15/12* (2006.01)

(52) U.S. Cl.
CPC ..... *A61G 15/02* (2013.01); *A47C 1/03211* (2013.01); *A61G 15/125* (2013.01)

(58) Field of Classification Search
CPC .... A61G 15/02; A61G 15/005; A61G 15/007; A61G 15/125; A47C 1/03211; A47C 1/03205
See application file for complete search history.

(56) References Cited

U.S. PATENT DOCUMENTS 3,845,945 A * 11/1974 Lawley ..... A61G 15/005 5/602
3,934,929 A * 1/1976 Rabinowitz ..... A47C 1/035 297/75
4,722,566 A * 2/1988 Castellini ..... A61G 15/02 297/330
5,190,349 A * 3/1993 Austin, Jr. ..... A61G 15/02 297/316
5,624,159 A * 4/1997 Celoni ..... A47C 1/0248 297/325
6,106,065 A * 8/2000 Carroll ..... A47C 1/0347 297/325
6,450,578 B1 * 9/2002 Taggett ..... A47C 1/0347 297/173
8,061,664 B2 * 11/2011 Ochsner ..... A61G 15/02 248/188.8

(Continued)

FOREIGN PATENT DOCUMENTS

CN 103156750 6/2013
EP 3108867 12/2016

*Primary Examiner* — Philip F Gabler
(74) *Attorney, Agent, or Firm* — Themis Law

(57) ABSTRACT

A mechanism for a reclining having a headrest and a backrest movable with respect to a seat, the backrest being supported by a reclining mechanism which includes an arc fastened to pads sliding in guiding plates, actuated by a motoreducer, and a mobile trapezoidal lever that is mobile backward and forward and that supports a bottom roller that is stationary and a top roller that is integral with the frame of the seat. The rollers are pivotable around axes that are parallel and are perpendicular to a longitudinal axis of the chair, so that, simultaneously with the shifting of the pads along the guiding plates, the frame of the seat performs a rheonomous tilting movement, upward or downward of its end corresponding to the anterior end of the chair seat.

9 Claims, 6 Drawing Sheets

(56) References Cited

U.S. PATENT DOCUMENTS

| | | | | |
|---|---|---|---|---|
| 8,936,315 | B2 * | 1/2015 | Fienup | A61G 15/02 297/330 |
| 2017/0252242 | A1 * | 9/2017 | Young | A61G 5/1059 |
| 2020/0029696 | A1 * | 1/2020 | Romano | A61G 15/02 |
| 2020/0121537 | A1 * | 4/2020 | Girelli | A61G 15/00 |

* cited by examiner

DENTAL PATIENT CHAIR

FIELD OF THE INVENTION

The present invention relates to the technical field of patient chairs used in dental practice. More particularly, the invention relates to an apparatus and a method allowing the movement of chairs synchronizing a first mechanism that reclines the backrest with respect to the seat of chairs, and to a second compensation mechanism that moves the seat along the longitudinal axis of the chair during reclining.

BACKGROUND OF THE INVENTION

In the history of dentistry, at least until the 1960's, dentists used to work standing, while today dentists habitually work sitting. Dental unit manufacturers strive to provide dental treatment units allowing dentists to work ergonomically, i.e. comfortably and without damaging their musculoskeletal system while providing dental therapy.

At the same time, dental patient chairs must be comfortable for patients: a patient feeling comfortable is more relaxed, and for dentists working is easier.

In the known art, there are provided two kinds of patient chairs:

Patient chairs provided with a seat consisting in a unique part, whose only articulation is at the level of patient's hip; this means that patient's thighs and distal portion of legs form a steady angle;

Patient chairs having a two-part seat, having a first articulation at the level of patient's hip, and a second articulation at the level of patient's knee. In these chairs provided with a two-part seat, patients can seat upright as in any chair, with the distal leg portion forming an angle of about 90° with respect to thighs. In this kind of chairs there is provided a seat, which remains substantially parallel to the floor, and a leg-rest, which can rotate from a positions substantially parallel to the floor, to a position substantially perpendicular to the floor; in other words, the angle between thighs and distal portion of legs is variable.

An appreciated feature of dental patient chairs is the possibility of holding the patient in the Trendelenburg position. The Trendelenburg position, or anti-shock position, is the position wherein a patient lies in case of shock or during the performance of specific operations: the patient is supine, lying so that her/his head is lower than her/his knees and pelvis, to help blood flow to the brain. Moreover, the Trendelenburg position reclines the patient's body allowing chest and legs to form an angle, instead of having chest and legs aligned in a position that can be uncomfortable for patients. The Trendelenburg position eases the dentist's work in performing different types of therapies.

A problem linked to the reclining of backrest is that while the backrest reclines, patient's head, on which the dentist operates, progressively relocates in space, from a position substantially aligned with her/his hip joint, to a position wherein patient's head is at a marked distance from patient's hip, say in the order of tens of centimeters. This forces the dentist, normally positioned on patient's side or behind the patient, to replace along with backrest reclining with respect to the room and the dental treatment unit. The figures, particularly FIGS. 3 and 4, will help to better clarify this effect.

Moreover, when the working position is aligned with the chair longitudinal axis, and therefore the dentist is positioned behind patient's head, often when reclining the chair no room is left for the dentist. Therefore, wide spaces become necessary to accommodate the dental treatment unit and all the accessories and tools needed by the dentist.

Manufacturers have been producing dental chairs for over 100 years; a patent concerning dental patient chairs is e.g. U.S. Pat. No. 3,804,460 to Pelton & Crane.

The above-quoted patent, with many others, describes patient chair internal structure, allowing the movement of the chair. In fact, while in use the chair has typically a position, in which its backrest is at about 90° with respect to the floor (upright position) and a position, in which the backrest is substantially parallel to the floor (reclined position), with all the intermediate positions between said two extremities. A wide variety of relatively complex mechanisms and actuators allow obtaining said positions.

The same applicant filed the application EP3108867A1, describing a dental patient chair wherein the backrest is supported by an oscillating mechanism, comprising:

at least a cam having a pre-set curvilinear contour; said cam supports said seat and is at least oscillating around an axis substantially corresponding to an oscillating axis of the seat;

at least a carriage or a slide;

at least a leading hole for said carriage, which extends substantially in the direction of the contour of said cam;

said carriage having cooperating means with the contour of said cam, while said carriage is slidingly actuated by the oscillating mechanism of the backrest, so that when said carriage slides inside said leading hole thanks to an actuating system, said carriage, interfering with cam's contour, commands at least an oscillatory movement controlled by the contour of the cam itself, said cam being freely movable by said oscillation from a position wherein it cooperatively interferes with said cooperating carriage means to a position wherein said cam is at a distance from said cooperating means.

Nonetheless, the mechanical solution described in EP3108867A1 has shown some limits upon mechanical testing, for example, the stress of the supporting roller and the friction between roller and pin are excessive.

SUMMARY OF THE INVENTION

Aim of the present invention is providing a mechanism allowing to bring chair backrest from the upright position to the reclined position and vice versa, which is efficient and of economic construction, and overcoming the drawbacks of the preceding solution.

A second aim of the present invention is limiting the repositioning of the dentist linked to chair reclining. The mechanism according to the present invention produces a movement of the backrest that is synchronized with the seat movement, which tilts up to reaching an ergonomically correct position of the patient, in case of need up to the maximal extension in the Trendelenburg position. In other words, during backrest reclining a forward sliding (in the direction of patient's feet) of the backrest and at the same time of the seat occurs. This has the aim of compensating the sheer movement generated by backrest reclining, were it hinged to a stationary rotation axis, so that patient's head remains as much as possible in the same position held when the patient is upright (longitudinal compensation movement or sliding). This movement allows maintaining the relative position of patient's head with respect to hydrogroup, instruments table, scialytic lamp and environment (furniture and walls of the dental practice).

A third aim of the present invention is obtaining a chair capable of moving along the longitudinal axis of the chair when the chair itself is reclined. Said movement is useful to align patient's oral cavity to the position of viewing instruments, like e.g. dental microscopes. In fact, said microscopes have a very wide magnifying factor, and therefore what the dentist desires to observe magnified must be perfectly aligned with the microscope objective.

A further aim is obtaining a chair structure having a manufacturing modularity:

Unique-part seat patient chair having (1) the Trendelenburg position obtained through backrest reclining, wherein longitudinal compensation movement is absent;

Patient chair with unique-part seat, reaching (1) the Trendelenburg position and (2) longitudinal compensation;

Patient chair with two-part seat comprising (1) the Trendelenburg position, (2) longitudinal compensation, (3) relative movement between seat and leg-rest.

Starting from the same basic structure for lifting the chair and adding the structure seat-backrest, modifying the system of movement of the structure seat-backrest, and increasing the number of motoreducers, the performances of the patient chair can be differentiated from low-end to high-end product. In this way, the client can be provided with a complete range of performances with a reduced production cost, linked to the limitation of production codes.

This object is achieved by an apparatus and a method having the features described herein. Advantageous embodiment and refinements are also disclosed herein.

Substantially, the chair according to the present invention is provided with two mechanically distinct systems. The first system allows the reclining of chair backrest and the tilting of chair seat, up to the extreme Trendelenburg position. Said first mechanism works thanks to a lever having a trapezoidal shape provided with two distinct heights, a front height (toward the patient's feet) and a back height (toward the patient's head), on which a pair of pads slides. The shape and the front and back heights of said lever allow obtaining the two extreme positions wherein said backrest is completely upright or completely reclined. The up and down mechanism is actuated by the action of a first motoreducer.

The second mechanical system according to the present invention is provided in the form of two frames sliding one with respect to the other, using a sliding system providing on one chair side a recirculating ball screws linear guide rail and on the other chair side a C-shaped guide provided with two rollers. Said second system is actuated by a second motoreducer, making use of a rack-pinion system.

The synchronization of the two motoreducers obtained through firmware (i.e. the software contained in chair's electronic boards) allows realizing a movement wherein the reclining of the backrest is synchronized with the longitudinal compensation movement.

In a preferred embodiment, when the patient chair is reclined, i.e. with an angle of the backrest with respect to the floor of maximum 15°, the two reclining and sliding movements can be de-synchronized, actuating the sliding motoreducer only. This allows centering the patient's oral cavity with respect to viewing systems like e.g. dental microscopes.

BRIEF DESCRIPTION OF THE DRAWINGS

Further advantages and properties of the present invention are disclosed in the following description, in which exemplary embodiments of the present invention are explained in detail based on the drawings.

DETAILED DESCRIPTION OF EMBODIMENTS OF THE INVENTION

Figure 1:
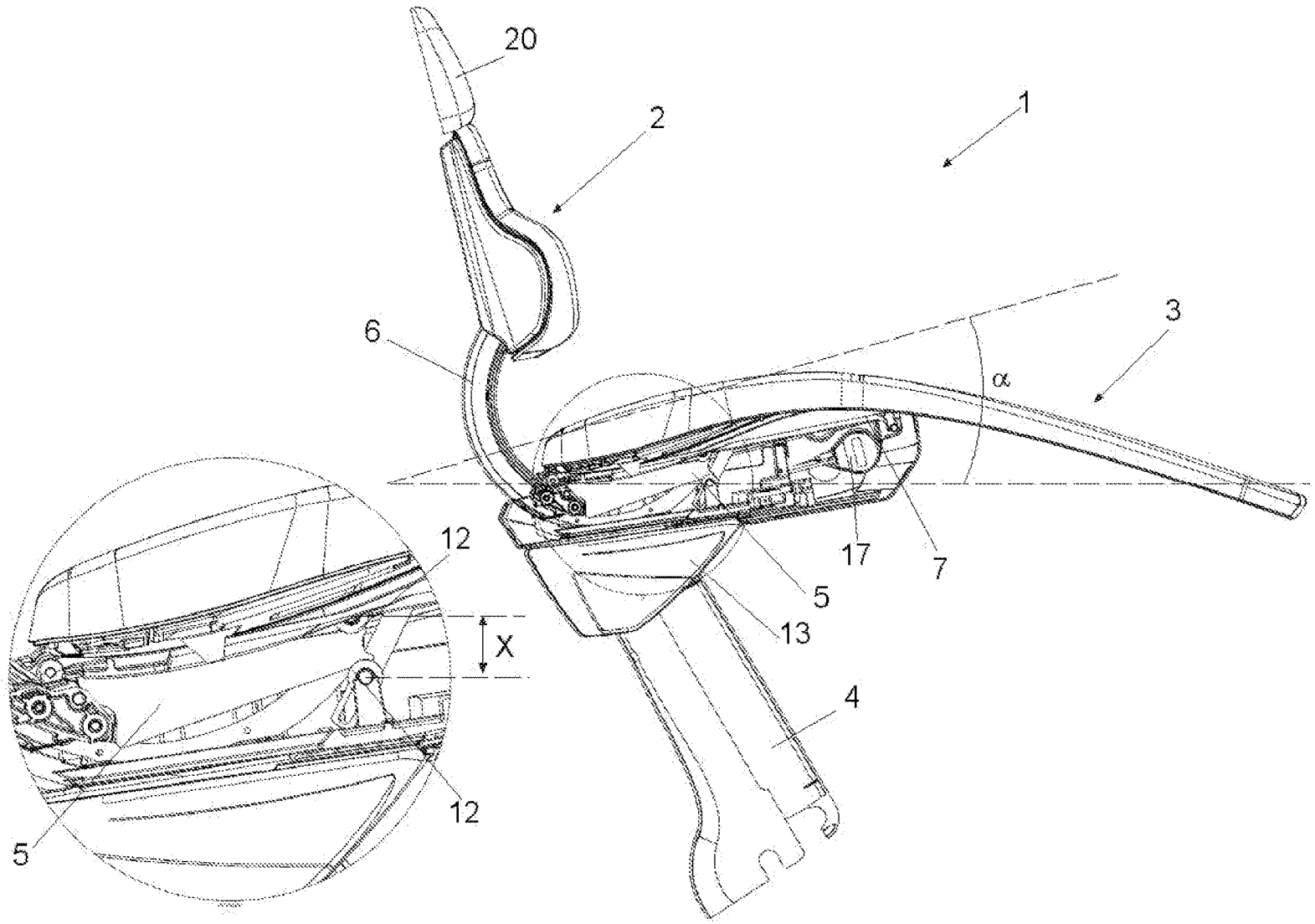
FIG. 1 is a side view of a dental chair with upright backrest.

FIG. 1 shows a typical dental chair 1 with a completely upright backrest, nearly perpendicular to the floor. The illustrated chair 1 is provided with a seat comprising a unique portion.

Said chair 1 comprises a backrest 2, a headrest 20, a seat 3 and a pantograph arm 4 fastened to a not-shown floor base. Backrest 2 and seat 3 are connected through an arc 6. The pantograph arm 4 allows the up and down movement of the seat 3, indicatively from a height of 380 mm to a height of 810 mm. The upper end of the pantograph arm is formed by a frame 13 supporting the reclining movement of the backrest and the synchronized movement of the seat.

In the detail of FIG. 1 shown in the circle, there is provided a lever 5 fastened to said arc 6. Said lever forms an extension in the longitudinal direction towards the seat portion of arc 6.

In FIG. 1, said lever 5 is in its back position (toward patient's head) when the backrest 2 is completely upright. Said position defines the height X of a frame 7 to which the seat 3 is integrally fastened. Said seat 3 forms an angle $\alpha$ of about 12° with respect to the floor. Said angle $\alpha$ can be modified varying the front height of lever 5.

The backrest 2 is integrally connected to said arc 6, which in its turn is connected through a pair of pads 8 to guiding plates 9 (visible in FIG. 5), which in their turn are attached to a frame 10. The frame 10 linearly slides with respect to frame 13 through a linear guide rail 11 placed on the right side of the chair, corresponding to the right of a patient sitting on said chair, and through a C-shaped 18 guide provided with two rollers placed on the left side of the chair, corresponding to the left of a patient sitting on said chair. The linear guide rail 11 and the C-shaped guide 18 are parallel to each other, and are parallel to the longitudinal axis of said chair. They allow the frame 10 to shift in the anterior-posterior direction of the chair with respect to frame 13, i.e. forward or backward. The asymmetry of the two guiding systems was chosen in order to facilitate the mounting of the chair, as it requires lesser precision restraint.

Figure 2:
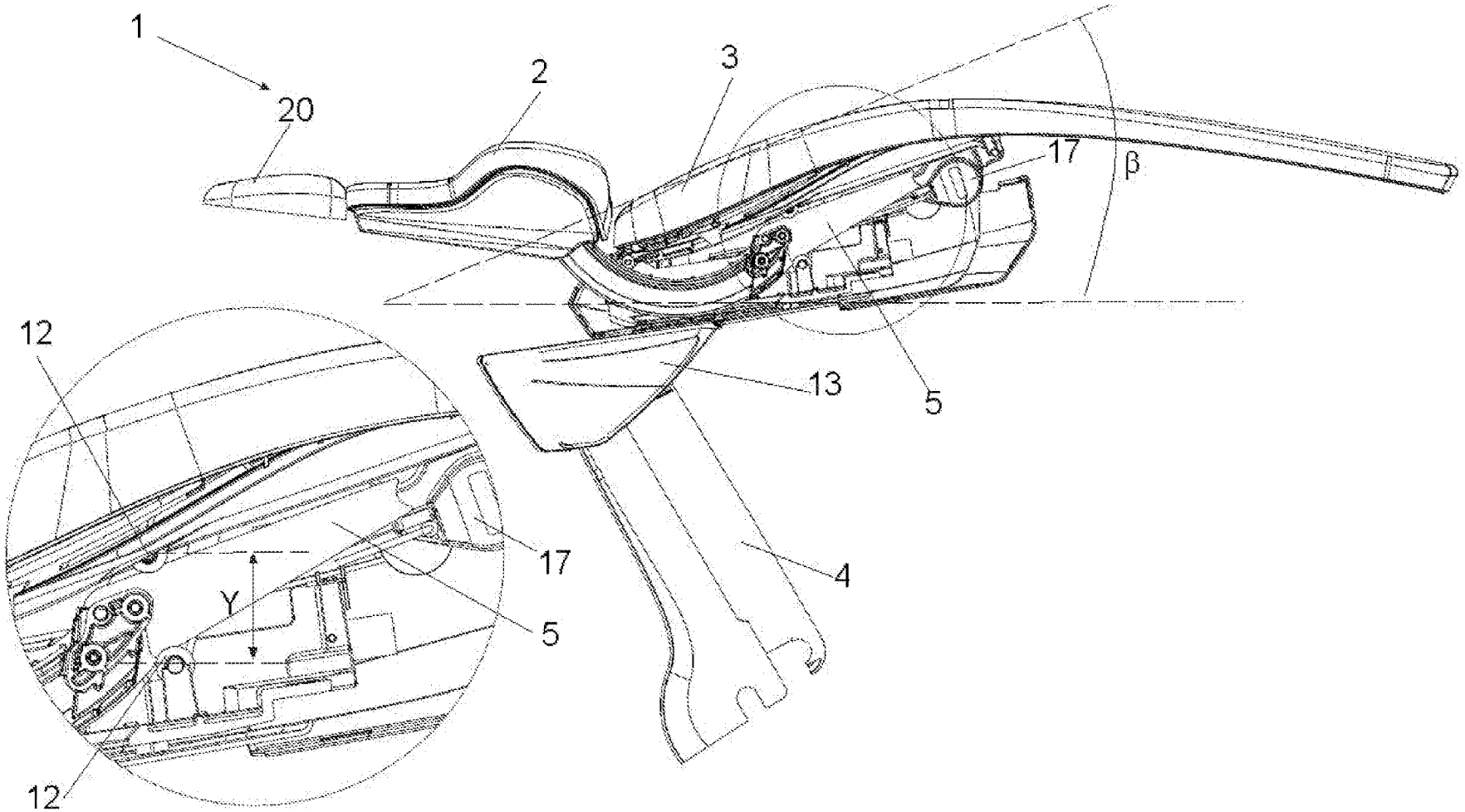
FIG. 2 is a side view of a dental chair with reclined backrest.

FIG. 2 shows the same chair 1 with its backrest 2 in the reclined Trendelenburg position, nearly parallel to the floor, while the seat 3 forms an angle $\beta$ of about 20° with respect to the floor. FIG. 2 shows said lever 5 fastened to the arc 6 while said lever 5 is in its front position (toward the patient's feet) when the backrest 2 is completely reclined. Said position defines the height Y of the frame 7 on which the seat 3 is integrally fixed. Said frame 7 rotates because it is hinged on the guiding plate 9.

The movement of the backrest 2 with respect to the seat 3 is actuated by a motoreducer 17 fastened to the arc 6 and the frame 7.

In the detail of FIG. 2 said lever 5 is shown in its extreme forward position (toward patient's feet) when the backrest is completely reclined. The advancing of the lever 5 is allowed by a pair of rollers 12, each roller being placeable to one of the head-feet ends and in all the intermediate positions of said lever 5, the bottom roller being fixed to frame 10 and the top roller being fixed to frame 7. Said position defines a height Y>X, allowing the seat 3 to reach the Trendelenburg position. Said lever 5 is provided with an overall trapezoidal shape, with its major base placed toward patient's head and its minor base placed toward patient's feet, said bases being substantially perpendicular to the floor, while the legs are substantially in the direction of the chair longitudinal axis. The difference in length of the two major and minor bases of lever 5 is responsible of the upward inclination of seat 3 in the Trendelenburg position. The law of motion through which the backrest 2 moves with respect to the seat 3 is defined by the shape of the lever 5; modifying its shape and/or heights of its vertical sides, a different law of motion can be obtained.

Figure 3:
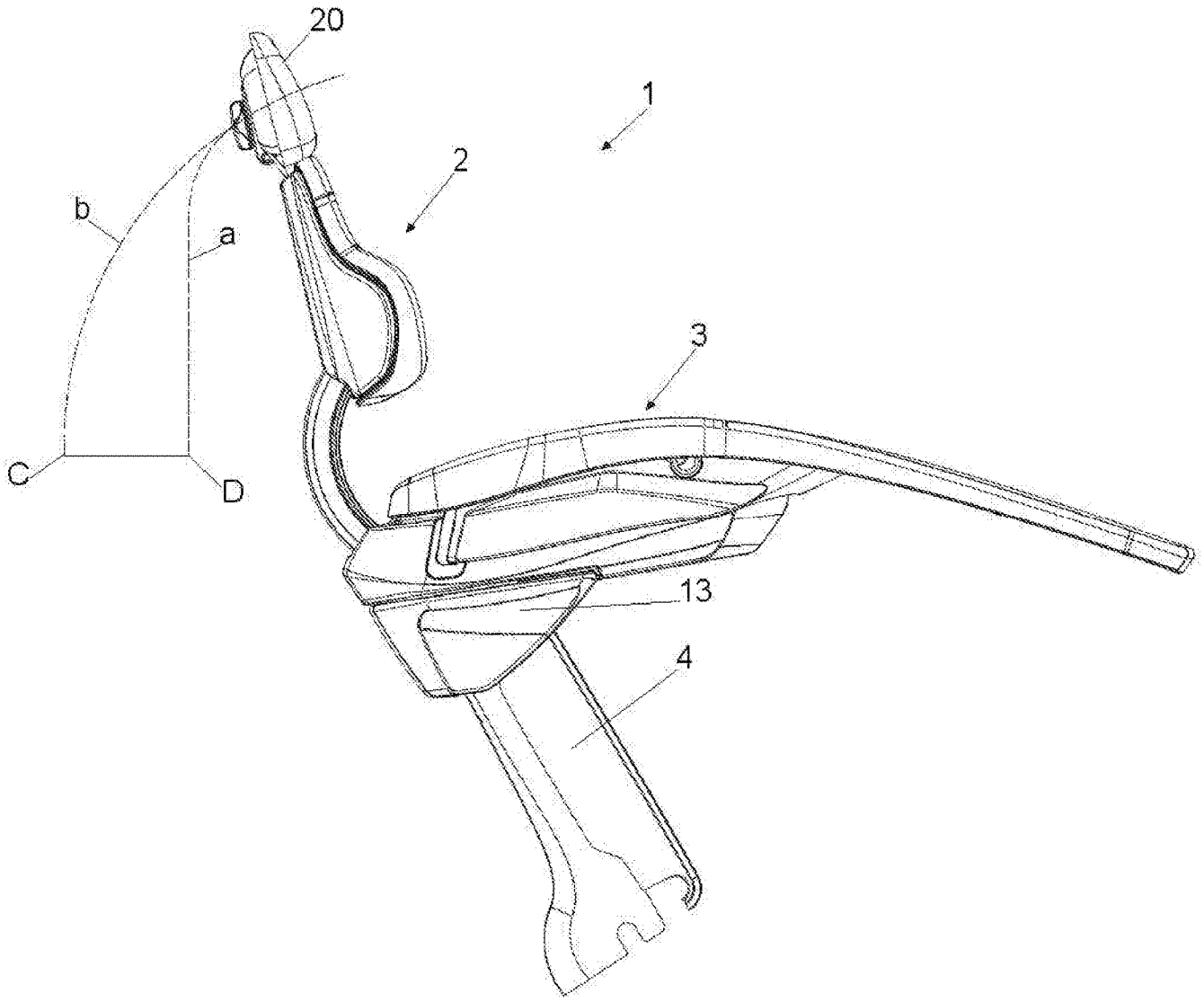
FIG. 3 is a side view of a dental chair with upright backrest.

FIG. 3 shows said chair 1 in a side view with its backrest 2 in its extreme upright position. The dotted lines show the effect of the longitudinal compensation movement or sliding on the position of (not shown) patient's head. When the patient is seated like in FIG. 3, her/his head is supported by the headrest 20, and her/his oral cavity is about in the position wherein the lines a and b intersect. When the backrest is reclined without sliding, patient's head describes an arc of a circle b that brings said head in the final position C. On the other hand, when the sliding is working, the seat 3 slides forward toward patient's feet in a way synchronized with backrest 2 down movement, determining a vertical trajectory bringing patient's head in the definitive position D. In this way, the dentist does not need to reposition and to reposition the scyalitic lamp in order to adjust to the final position of the reclined patient. Indicatively, with the mechanism according to the present embodiment, the linear distance between C and D points is about 175 mm.

Figure 4:
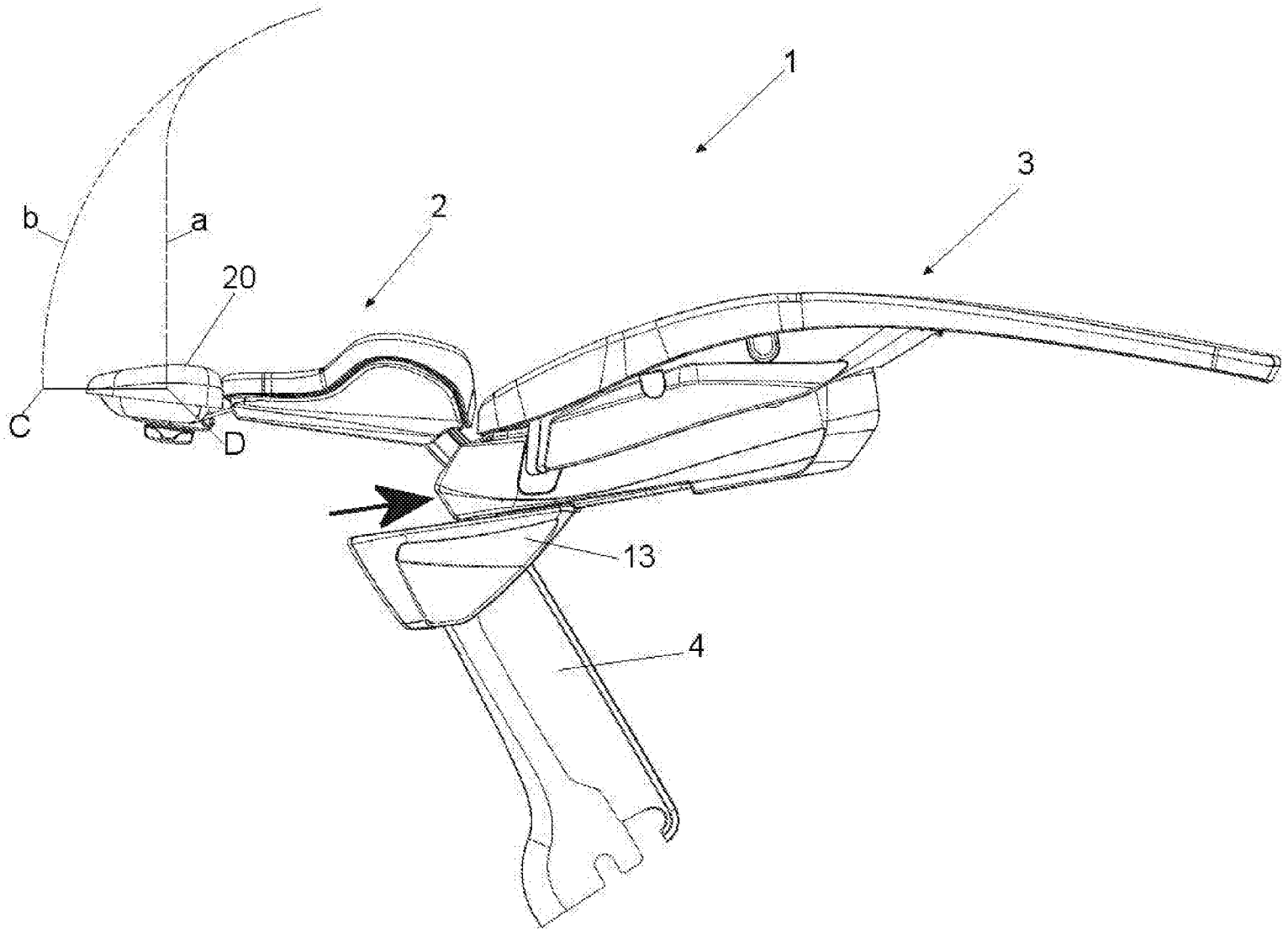
FIG. 4 is a side view of a dental chair with reclined backrest.

FIG. 4 shows the chair 1 with its reclined backrest 2, wherein one can appreciate that the seat 3 slid with respect to the pantograph arm 4. The bold arrow indicates the direction of the front sliding. The linear movement between frame 7 and frame 13 occurs in a direction not perfectly parallel to the floor, but with a tilting of about 8.5 degrees.

Figure 5:
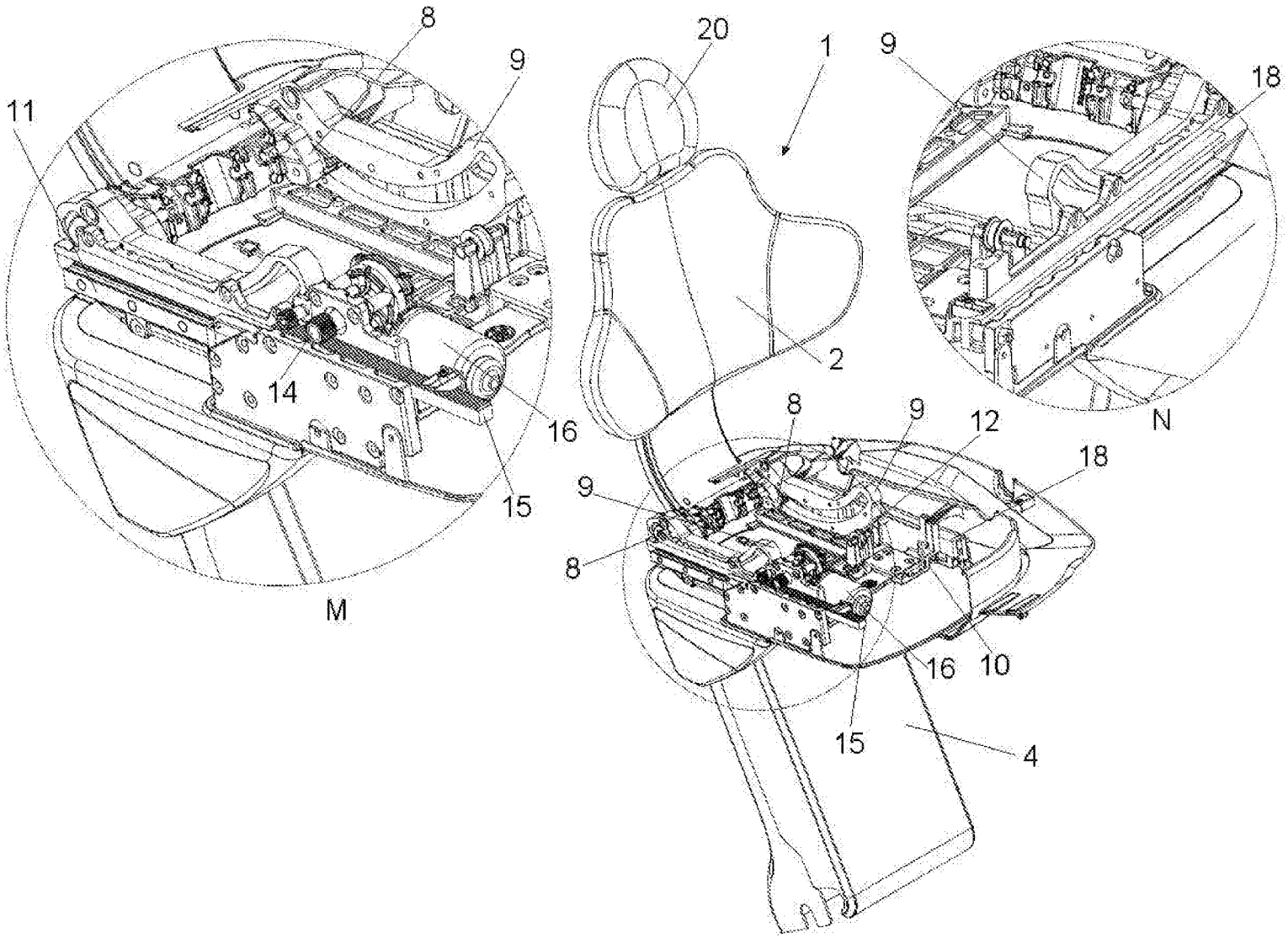
FIG. 5 is an axonometric view of the inside of the seat, with details M and N to better explain the device.

According to a further feature better visible in FIG. 5, said arc 6 is provided with a pad 8 for each side of the chair oriented in the longitudinal direction of the chair itself, i.e. head-feet with reference to patient's position; each of said two pads is engaged in the arcuated track of a corresponding guide 9. In the illustrated embodiment, said arcuated track is in the form of a hole, wherein wheels of pad 8 are engaged.

Just one lever coupled with just one pad 8 can be provided, or one lever for each pad 8.

An embodiment provides just one lever mounted in an intermediate position between two pads 8, and connected, at its end oriented towards the back side of the chair, in an intermediate point of the end of the arc 6 oriented toward the anterior end of the chair, i.e. the feet end, which intermediate point is aligned with rollers 12 along an axis parallel to the longitudinal axis of the chair.

According to a further embodiment, the lever/s is/are fixed in an oscillating way in the vertical plane oriented parallel to the longitudinal axis of the chair, having its/their fulcrum with their posterior and to the corresponding end of the arch 6 or of pads 8.

Concerning the mechanism linking the movement of the backrest to the movement of the seat, the pads 8 moving inside their respective guides 9 determine a movement of said lever/s backwards and forwards, and therefore the interposition between the rollers 12, the one fixed to seat frame and that fixed to the frame 11 of areas of the lever/s 5 having a different height, i.e. a different distance from the two top and bottom edges. According to the direction of movement of the backrest and therefore of said lever/s, this causes a rising or a lowering of the seat, thanks to a bigger or smaller tilting of the seat with respect to the horizontal plane.

FIG. 5 shows an axonometric view of the moving mechanisms of chair 1 placed under seat 3. The detail M is a magnified detail of the right side of the chair, indicated with the circle in the overall figure. The detail N is a magnified detail of the left side of the chair.

To realize the sliding movement a system pinion 14-rack 15 is used, controlled by a motoreducer 16. The synchronization between motoreducer 16 and motoreducer 17 allowing the simultaneous reclining of backrest 2 and the front sliding of seat 3 is obtained through the firmware programming of electronic boards controlling the motoreducers 16 and 17.

Figure 6:
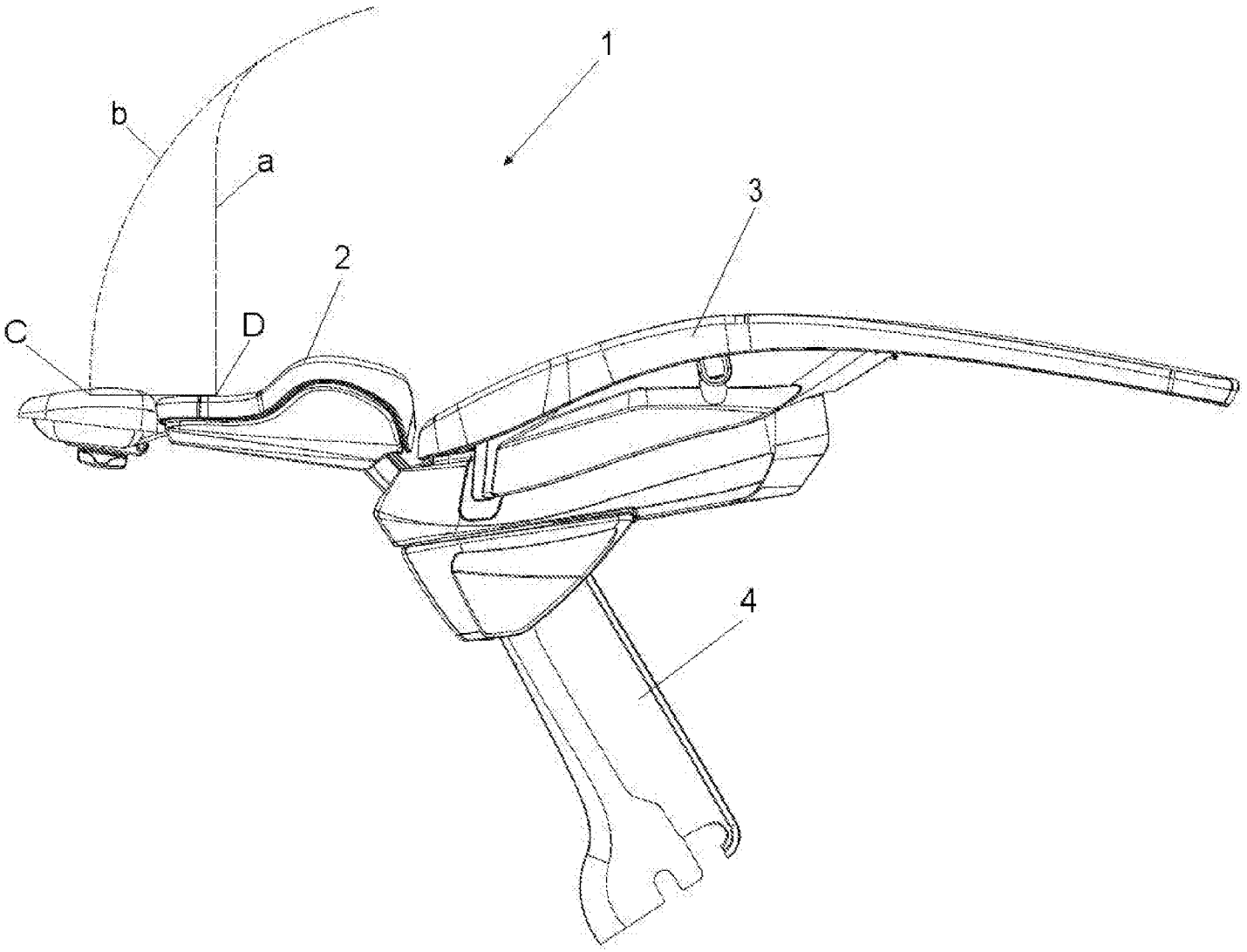
FIG. 6 is a side view of the chair with the backrest in reclined position in the extreme position obtainable to observe patient's oral cavity through a dental microscope.

FIG. 6 shows a preferred embodiment, thanks to which, when the backrest 2 is reclined, the chair 1 can be moved annulling the synchronization of the motoreducers 16 and 17, and using the motoreducer 16 only. This allows to move the lying patient along the longitudinal axis of the chair, i.e. the longitudinal axis of the patient lying on the chair, in particular to move patient's head between the positions C and D with a millimeter accuracy, so that the position of patient's oral cavity can be adjusted with respect to viewing instruments, like e.g. dental microscopes. In other words, the patient is moved in lieu of the microscope.

The sliding of the chair in the direction of the patient's head is possible only when the backrest 2 is completely reclined or forming an angle of at least 15°; anyway dental microscopes are generally used when the patient is reclined, not upright.

Adding to the described mechanisms a further motoreducer and splitting the seat 3 at the height of knee joint, a chair with maximal performances can be obtained. Obviously, this further motoreducer is controlled through a programming firmware allowing a synchronization of the movement of chair leg portion to the chair reclining and to the longitudinal compensation movement.

LISTING OF REFERENCE NUMBERS

1. Dental chair
2. Backrest
3. Seat
4. Pantograph arm
5. Lever
6. Arc
7. Frame
8. Pads
9. Guiding plate
10. Frame
11. Linear guide rail
12. Rollers
13. Frame
14. Pinion
15. Rack
16. Sliding motoreducer
17. Backrest motoreducer
18. C-shaped guide
20. Headrest

The invention claimed is:

1. A reclining chair adapted to be reclined up to a Trendelenburg position, the reclining chair comprising a headrest, a backrest, and a seat, the backrest being movable with respect to the seat and being supported by a mechanism, the mechanism comprising:

an arc fastened to pads sliding in guiding plates actuated by a first motor with gear reduction for reclining;

a mobile lever having a trapezoidal shape; and a pair of rollers disposed on opposite vertical sides of the mobile lever, the pair of rollers comprising a bottom roller that is stationary and a top roller that is integral with a frame of the seat, the bottom roller engaging a lower edge of said mobile lever and the top roller engaging a top edge of said mobile lever;

wherein the mobile lever is mobile backward and forward along a longitudinal axis of the reclining chair together with the pads, wherein the mobile lever has two opposed convergent lateral edges directed in a direction of the longitudinal axis of the reclining chair, and wherein the rollers are pivotable around parallel axes that are perpendicular to the longitudinal axis of the reclining chair, so that, simultaneously with a shifting of the pads along the guiding plates forward and backward, respectively, the frame of the seat performs a rheonomous tilting movement, upward or downward, of an end of the frame corresponding to an anterior end of the seat.

2. The reclining chair according to claim 1, wherein a shape of the mobile lever and different heights of front and back sides of the mobile lever determine a tilting of the seat, both when the reclining chair is in upright position, and when the reclining chair is in the Trendelenburg position.

3. The reclining chair according to claim 1, wherein the mechanism is further adapted for longitudinal compensation of the reclining chair, further comprising a second frame for the seat so as to have two frames disposed to slide on one another and causing the seat and the backrest, which are integral to each other, to slide while the backrest is being reclined, the mechanism further comprising:

a C-shaped guide with two rollers placed on one chair side corresponding to a patient's side;

a linear guide placed on an opposed side of the reclining chair;

a rack and pinion system; and a second motor with gear reduction for longitudinal compensation, wherein the second motor with gear reduction for longitudinal compensation rotationally actuates the pinion.

4. The reclining chair according to claim 3, wherein actuation of the mechanism is synchronized with an electronic board bearing dedicated firmware allowing a simultaneous actuation of said first and said second motors with gear reduction for reclining and for longitudinal compensation, thereby synchronizing a reclining movement of the backrest with a longitudinal compensation movement of the seat.

5. The reclining chair according to claim 4, wherein the mechanism is adapted to uncouple the reclining movement and the longitudinal compensation movement when said backrest has reached a tilting of at least 45° with respect to a floor, thereby allowing only the longitudinal compensation movement towards the patient's head or feet.

6. The reclining chair according to claim 1, wherein the mechanism is implemented in the reclining chair having the seat made in one piece, and wherein thigh and distal portion of a patient's leg form a fixed angle.

7. The reclining chair according to claim 1, wherein the mechanism is implemented in the reclining chair having the seat split in two parts, and wherein thigh and distal portion of a patient's leg form a variable angle.

8. The reclining chair according to claim 1, wherein the reclining chair is a dental patient chair.

9. A method of moving, one with respect to the other, a backrest and a seat of a reclining chair, comprising:

providing the reclining chair according to claim 3, wherein a geometrical shape of the mobile lever determines extreme positions of the backrest and of the seat and annulling a synchronicity between the first and the second motors with gear reduction, thereby allowing the reclining chair to move in the longitudinal direction toward the patient's head or the patient's feet, so as to enable the reclining chair to self-center, and consequently to have the patient's oral cavity self-center, with respect a magnifying instrument.

* * * * *